US012781298B2

(12) United States Patent
Jäger et al.

(10) Patent No.: US 12,781,298 B2
(45) Date of Patent: Nov. 3, 2026

(54) METHOD FOR PRODUCING STEEL IN AN INTEGRATED METALLURGICAL PLANT

(71) Applicant: ThyssenKrupp Steel Europe AG, Duisburg (DE)

(72) Inventors: Nils Jäger, Mülheim (DE); Daniel Schubert, Duisburg (DE); Matthias Weinberg, Krefeld (DE)

(73) Assignee: (A) ThyssenKrupp Steel Europe AG, Duisburg (DE)

( * ) Notice: Subject to any disclaimer, the term of this patent is extended or adjusted under 35 U.S.C. 154(b) by 403 days.

(21) Appl. No.: 18/290,516

(22) PCT Filed: May 11, 2022

(86) PCT No.: PCT/EP2022/062762
§ 371 (c)(1),
(2) Date: Nov. 14, 2023

(87) PCT Pub. No.: WO2022/243129
PCT Pub. Date: Nov. 24, 2022

(65) Prior Publication Data

US 2024/0271232 A1 Aug. 15, 2024

(30) Foreign Application Priority Data

May 18, 2021 (DE) ..... 102021112781.5

(51) Int. Cl.
*C21C 5/28* (2006.01)
*C21B 5/00* (2006.01)
(Continued)

(52) U.S. Cl.
CPC ..... *C21C 5/28* (2013.01); *C21B 5/001* (2013.01); *C21B 7/002* (2013.01); *C21B 13/004* (2013.01);
(Continued)

(58) Field of Classification Search
CPC ..... C21C 5/28; C21C 2100/04; C21C 5/52; C21B 5/001; C21B 7/002; C21B 13/004;
(Continued)

(56) References Cited

U.S. PATENT DOCUMENTS 4,804,408 A 2/1989 Puhringer et al.
4,889,323 A 12/1989 Pusch et al.
(Continued)

FOREIGN PATENT DOCUMENTS

AT 385051 2/1988
CN 1430678 A 7/2003
(Continued)

OTHER PUBLICATIONS

German Office Action for DE Application No. 10 2021 112 781.5 mailed Jan. 5, 2022.
(Continued)

*Primary Examiner* — Danielle M. Carda
(74) *Attorney, Agent, or Firm* — RMCK Law Group PLC

(57) ABSTRACT

The present disclosure relates to a method for producing steel in an integrated metallurgical plant comprising at least one direct reduction reactor for directly reducing iron ore to give sponge iron, at least one electric furnace for melting the sponge iron to give pig iron or crude steel, at least one blast furnace for smelting iron ore to give pig iron, and at least one converter for refining pig iron to give crude steel. In accordance with the invention, the process gas discharged from the direct reduction reactor is admixed at least partly to the hot blast air and/or at least partly to an optional charging material, said air and/or said material being blown into the blast furnace.

12 Claims, 1 Drawing Sheet

(51) Int. Cl.
*C21B 7/00* (2006.01)
*C21B 13/00* (2006.01)

(52) U.S. Cl.
CPC .. *C21B 2005/005* (2013.01); *C21B 2100/282* (2017.05); *C21B 2100/80* (2017.05); *C21C 2100/04* (2013.01)

(58) Field of Classification Search
CPC ..... C21B 2005/005; C21B 2100/282; C21B 2100/80; C21B 2100/44; C21B 2100/64; C21B 2100/66; C21B 5/003; C21B 13/0046; C21B 13/0073; C21B 2100/00; C21B 2100/40; Y02P 10/122; F27B 3/085; F27B 19/00; F27B 19/04
USPC ..... 75/507
See application file for complete search history.

(56) References Cited

U.S. PATENT DOCUMENTS

| | | | | |
|---|---|---|---|---|
| 2004/0216560 | A1 | 11/2004 | Kepplinger et al. | |
| 2004/0226406 | A1 * | 11/2004 | Duarte-Escareno | C21B 13/143 75/452 |

FOREIGN PATENT DOCUMENTS

| | | | | |
|---|---|---|---|---|
| CN | 105586455 | A | 5/2016 | |
| DE | 3713630 | A1 | 11/1988 | |
| DE | 4421673 | A1 | 1/1995 | |
| DE | 102013113913 | A1 | 6/2015 | |
| EP | 1285096 | B1 | 11/2003 | |
| EP | 2937429 | A1 | 10/2015 | |
| EP | 1641945 | B1 | 12/2018 | |
| WO | 2013093640 | A2 | 6/2013 | |
| WO | WO-2020245070 | A1 * | 12/2020 | C21B 13/12 |

OTHER PUBLICATIONS

International Search Report and Written Opinion for International Application No. PCT/EP2022/062762 mailed Aug. 19, 2022.
Steffen et al., "Stand der Direktreduktion" Jun. 13, 1994, Dusseldorf, DE.
Chinese Office Action for CN Application No. 202280035784.4 mailed Feb. 27, 2026.
CN Search Report for CN Application No. 2022800357844 mailed Feb. 24, 2026.

* cited by examiner

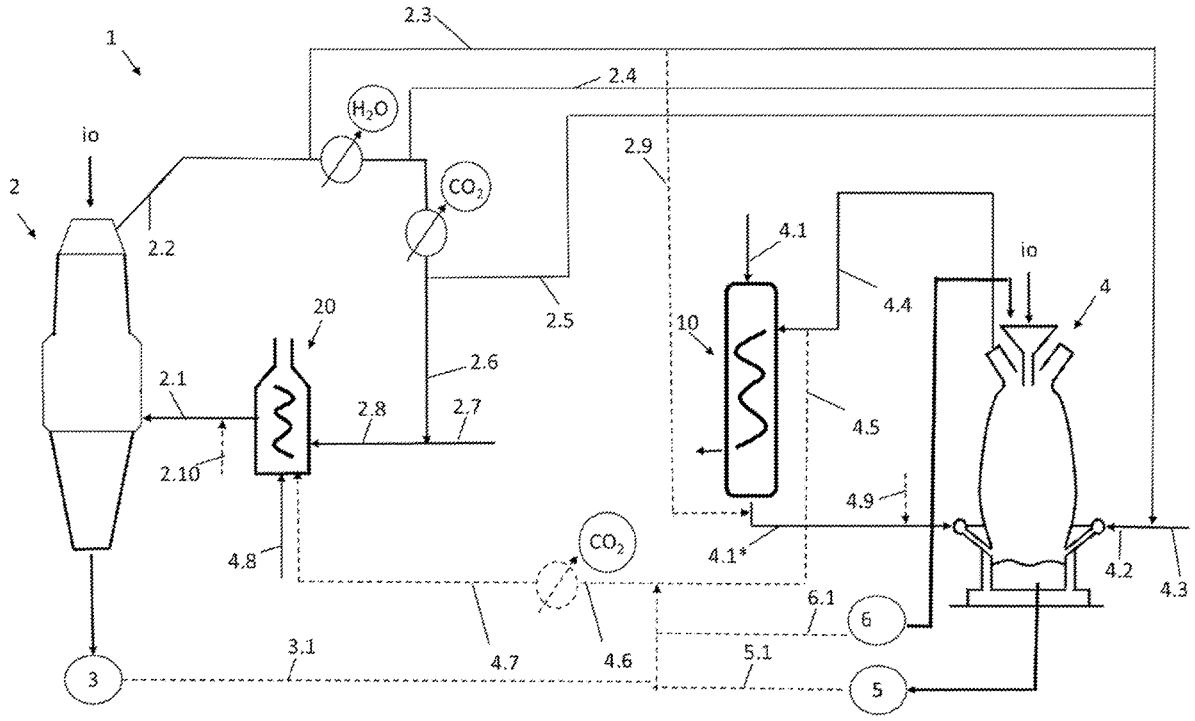
1
2
io
2.2
2.3
2.4
$H_2O$
$CO_2$
2.9
4.1
io
4
4.4
2.5
10
20
2.6
2.1
2.8
2.7
4.5
2.10
4.9
4.8
$CO_2$
4.1*
4.2
4.3
6.1
6
3.1
4.7
4.6
5.1
3
5

METHOD FOR PRODUCING STEEL IN AN INTEGRATED METALLURGICAL PLANT

CROSS-REFERENCE TO RELATED APPLICATIONS

This application is a 371 U.S. National Stage of International Application No. PCT/EP2022/062762 filed May 11, 2022 which claims the benefit of German Patent Application No. 10 2021 112 781.5 filed May 18, 2021. The disclosures of each of the above applications are incorporated herein by reference in their entirety.

The invention relates to a method for producing steel in an integrated metallurgical plant.

A generic method for steelmaking in an integrated metallurgical plant is disclosed illustratively in EP 1 641 945 B1. The use of an additional melter in an integrated metallurgical plant is shown on the homepage of the applicant at https://www.thyssenkrupp-steel.com/de/unternehmen/nachhaltigkeit/klimastrategie/"Zwei Technologiepfade-ein Ziel".

It is an object of the present invention to further develop a generic method in such a way that the energetically and physically valuable process gases present in an existing integrated metallurgical plant can be utilized in an economically optimized manner.

This object is achieved by a method for producing steel in an integrated metallurgical plant, comprising at least one direct reduction reactor for directly reducing iron ore to give sponge iron, at least one electric furnace for melting the sponge iron to give crude steel or pig iron, at least one blast furnace for smelting iron ore to give pig iron, and at least one converter for refining the pig iron to give crude steel, where in accordance with the invention the process gas discharged from the direct reduction reactor is admixed at least partly to the hot blast air and/or at least partly to an optional charging material, said air and/or said material being blown into the blast furnace.

In at least one direct reduction reactor, using a reduction gas consisting possibly of hydrogen and/or methane (natural gas), sponge iron is generated from iron ore and is melted in at least one melter to give crude steel or pig iron. Furthermore, in at least one blast furnace, iron ore and coke produced from coal in a cokery are smelted to give pig iron, which is in turn converted into crude steel in a converter, more particularly an oxygen converter, by refining—that is, by stripping in particular of carbon, sulfur and/or phosphorus. The individual stated apparatuses and corresponding methods are prior art and are processes established in practice.

It has surprisingly been recognized that the process gas discharged from the direct reduction reactor is of high energetic and physical value and can therefore be utilized in an integrated metallurgical plant profitably and environmentally in the blast furnace process in an optimal manner via the tuyeres, more particularly via the blowing lances, in the blast furnace.

The discharged process gas from the direct reduction reactor may at least partly replace or be admixed to an optional charging material. As a result, high-priced components for charging, in particular, such as hydrogen, or $CO_2$-intensive components, such as coal and/or natural gas, for example, may be partly or completely substituted, and so the costs and the $CO_2$ footprint of the feedstocks can be reduced.

The cold blast air used on a standard basis is air which, before it is blown into the blast furnace in the form of hot blast air via the tuyeres, is heated in an air heater (Cowper stove) to the necessary temperature. As and when required, oxygen may be admixed additionally before and/or after the heating. The pressure may also be increased before and/or after the heating. Depending on the capacity of the blast furnace, there are two or more air heaters operating in alternation (the functioning is known). The discharged process gas from the direct reduction reactor may alternatively or additionally be admixed at least partly to the hot blast air.

The matter of whether the hot blast air and/or the optional charging material may be replaced completely by the process gas discharged from the direct reduction reactor is dependent on the design and mode of operation of the corresponding apparatuses in the integrated metallurgical plant. At least part of the discharged process gas is supplied to the blast furnace via the tuyeres, and so a mixed gas made up of process gas, hot blast air, and optional charging material is blown in.

The phrase "at least part of the discharged process gas" means either that only part of the discharged process gas is supplied to the blast furnace and the remainder is utilized outside the blast furnace process, or that it may be supplied completely to the blast furnace process.

Admixing may also be understood as supplying.

The process gas discharged from the direct reduction reactor, depending on the composition of the reduction gas used, contains as yet unreacted fractions which may be used profitably in the blast furnace process for reduction and for smelting of iron ore, coke and further adjuvants, these fractions comprising, in particular, compounds or mixtures of carbon and oxygen ($CO$, $CO_2$), methane ($CH_4$), hydrogen ($H_2$) and/or water vapor ($H_2O$) and also impurities that are an unavoidable contaminant of the process.

According to one embodiment of the invention, the discharged process gas is admixed at least partly directly to the hot blast air and/or at least partly directly to the optional charging material. This means that the process gas as it is discharged from the direct reduction reactor is supplied directly, in particular via corresponding supply conduits, to the blast furnace process, preferably without having to pass through a stage for processing of the process gas.

According to one alternative embodiment of the invention, the discharged process gas is first dehumidified and then admixed as dehumidified process gas at least partly to the hot blast air and/or at least partly to the optional charging material. The discharged process gas is passed through a unit, as for example through a condenser, and cooled correspondingly, so that the water vapor present in the process gas condenses and is therefore removed from the process gas. Through the condensing and removal of the condensate, the process gas is "dehumidified". This allows the quality of the process gas to be increased.

In another embodiment of the invention, the discharged $CO_2$ fraction contained in the process gas or in the dehumidified process gas is removed and then admixed as carbon dioxide-free process gas at least partly to the hot blast air and/or at least partly to the optional charging material in the blast furnace. The process gas is passed through a unit in which compounds or mixtures of carbon and oxygen such as carbon dioxide ($CO_2$) are deposited, by means for example of $CO_2$ removal in the form of an amine scrub, carbonate scrub, membrane separation technology, such as selective membranes, for example, or a PSA (pressure swing adsorption). In order to further improve the climate balance, the carbon dioxide removed from the process gas may be stored, for example, in a suitable environment, and/or utilized via CCS (carbon capture and storage) or physically as part of a CCU (carbon capture and utilization) method. Furthermore, the carbon dioxide ($CO_2$) may also be utilized physically as possible cooling gas or part of a possible cooling gas in an optional cooling zone in the direct reduction process.

In the direct reduction reactor, a reduction gas is fed in for reducing the iron ore to give sponge iron, this gas, before being fed into the reduction zone of the direct reduction reactor, being first heated in a reduction gas heater to an appropriate temperature.

For this purpose, according to one embodiment of the invention, as fuel gas or as additive gas to the fuel gas for firing the reduction gas heater, the process gas discharged from the electric furnace may be provided at least partly as fuel gas for firing the reduction gas heater of the direct reduction reactor. Alternatively or additionally, the process gas discharged from the electric furnace may be blown at least partly into the blast furnace via the tuyeres.

The integrated metallurgical plant further comprises a cokery, which generates the coke for the blast furnace process in the immediate vicinity from coal. According to one alternative embodiment of the invention, the process gas discharged from the cokery may be provided at least partly as fuel gas for firing the reduction gas heater of the direct reduction reactor. Alternatively or additionally, the process gas discharged from the cokery may be blown at least partly into the blast furnace via the tuyeres.

The integrated metallurgical plant further comprises a steel plant having at least one converter, as for example an LD converter (alternatively called BOF converter), in which the pig iron is optimized to give crude steel for onward processing; in this case, according to one further alternative embodiment of the invention, the process gas discharged from the converter may be provided at least partly as fuel gas for firing the reduction gas heater of the direct reduction reactor. Alternatively or additionally, the process gas discharged from the converter may be blown at least partly into the blast furnace via the tuyeres.

Another possibility, according to a further alternative embodiment of the invention, is to provide the process gas discharged from the blast furnace at least partly as fuel gas for firing the reduction gas heater of the direct reduction reactor.

The use of the discharged process gas from electric furnace, cokery, converter or blast furnace may substantially improve the energy balance of an integrated metallurgical plant.

A further improvement in the energy balance may be achieved if, according to one embodiment of the invention, at least two discharged process gases from electric furnace, cokery, converter and blast furnace are merged and provided at least partly as fuel gas for firing the reduction gas heater of the direct reduction reactor. Alternatively or additionally, at least two discharged process gases from electric furnace, cokery and converter may be merged and blown at least partly into the blast furnace via the tuyeres.

The invention is elucidated in more detail with reference to the following working examples in conjunction with FIG. 1. FIG. 1 here shows an example of a method of the invention in a schematic representation of an integrated metallurgical plant for producing steel and/or pig iron.

The integrated metallurgical plant (1) comprises at least one direct reduction reactor (2) for directly reducing iron ore (io) to give sponge iron, at least one electric furnace (3) for melting the sponge iron to give crude steel or pig iron, at least one blast furnace (4) for smelting iron ore (io), with especially coke, pulverized coal and further adjuvants, to give pig iron, and at least one converter (5) for refining pig iron to give crude steel. Furthermore, the integrated metallurgical plant (1) comprises at least one cokery (6) for the coking of coal to give coke.

Iron ore (io) is introduced both into the direct reduction reactor (2), which may be configured, for example, as a shaft furnace and therefore equipped accordingly at the top end, and into the blast furnace (4), together with coke from the cokery (6) and further adjuvants, such as limestone, for example, introduction taking place in particular in layers via the charge. At the lower end of the direct reduction reactor (2), the sponge iron generated is taken off and supplied to an electric furnace (3) for melting the sponge iron, in particular with addition of further additives such as steel scrap, for example. The pig iron obtained from the blast furnace (4) has to be refined in a converter (5) to give crude steel. The crude steel or pig iron from the direct reduction and melter facility, along with that from the blast furnace process, is supplied by the fastest route in the integrated metallurgical plant (1) to secondary metallurgy, for the desired steel to be processed and to be cast into intermediates, such as into flat or long products, for example.

As well as with iron ore (io), the direct reduction reactor (2) must also be charged with a reduction gas for expelling the oxygen from the ore, this gas consisting possibly of hydrogen and/or hydrocarbon-containing and/or carbon-containing compounds or mixtures (2.7) and flowing through the reactor (2) on a countercurrent principle from bottom to top. Before being charged, the reduction gas (2.1) is heated in a reduction gas heater (20) to a required operating temperature, of between 600 and 1300° C., for example.

Unconsumed reduction gas, together with any gaseous reaction products, is discharged as process gas (2.2) from the direct reduction reactor (2). The discharged process gas (2.2) may contain hydrogen ($H_2$), a compound or mixture of carbon and oxygen (CO, $CO_2$) and/or at least one hydrogen-containing compound ($H_2O$) and unavoidable impurities. In the standard process, the discharged process gas (2.2) would be passed back to the direct reduction reactor (2) in a circuit, with fresh gas (2.7) being additionally admixed to improve the reduction potential.

In accordance with the invention, the process gas (2.2, 2.3, 2.4, 2.5, 2.9) discharged from the direct reduction reactor (2) is admixed at least partly to the hot blast air (4.1*) and/or at least partly to an optional charging material (4.2), said air and/or said material being blown into the blast furnace (4). The process gas (2.2) discharged from the direct reduction reactor (2) has particularly high energetic and physical value and can therefore be physically utilized in the blast furnace process in an economic and environmental manner.

Before being blown into the blast furnace (4), the cold blast air (4.1) is heated in an air heater (10) to the required temperature, and then blown in as hot blast air (4.1*) via the tuyeres. The discharged process gas (2.2, 2.3, 2.4, 2.5, 2.9) from the direct reduction reactor (2) may be admixed at least partly to the hot blast air (4.1*). Alternatively or additionally, the discharged process gas (2.2, 2.3, 2.4, 2.5, 2.9) from the direct reduction reactor (2) may be admixed at least partly to an optional charging material (4.3). (Further) charging material (4.3) used may comprise, for example, hydrogen, oil, natural gas and/or coal powder (pulverized coal), which in that case may be blown in especially as a mixture (4.2), additionally, alongside the hot blast air (4.1*). As and when necessary, the hot blast air (4.1*) may be additionally enriched with oxygen (4.9).

There are therefore a number of variants for the economic and environmental introduction of the highly energetically and physically valuable process gas (2.2, 2.3, 2.4, 2.5, 2.9) from the direct reduction reactor (2) into the blast furnace (4), these variants being dependent in particular on the mode of operation (partial/full load) of the individual apparatuses (2, 4) and on the units that are or are not present (removal of $H_2O$, $CO_2$).

For example, the optional charging material (4.3) may be replaced entirely by the process gas (2.2, 2.3, 2.4, 2.5) discharged from the direct reduction reactor (2). In general, however, only part of the discharged process gas (2.2, 2.3, 2.4, 2.5) is admixed to the optional charging material (4.3), and so a mixed gas composed of process gas (2.2, 2.3, 2.4, 2.5), optional charging material (4.3) and hot blast air (4.1*) is blown into the blast furnace (4).

In the simplest variant, the discharged process gas (2.3, 2.9) is admixed at least partly directly to the hot blast air (4.1*) and/or at least partly directly to the optional charging material (4.3). It is therefore made available directly via corresponding supply conduits, without any need to pass through a stage for processing the process gas (2.3, 2.9).

In a further variant, the discharged process gas (2.2) is passed through a unit for water/water vapor removal, as for example through a condenser, and cooled accordingly, so that the water vapor ($H_2O$) present in the process gas (2.2) is condensed and therefore removed. Through the condensing and discharging of the condensate, the process gas (2.2) is "dehumidified" and admixed subsequently as dehumidified process gas (2.4, 2.9) at least partly to the hot blast air (4.1*) and/or at least partly to the optional charging material (4.3).

In a further variant, the discharged process gas (2.2) is passed through a unit for carbon dioxide removal, as for example through an amine scrubber, in order to remove the $CO_2$ fraction, and so may subsequently be admixed as carbon dioxide-free process gas (2.5, 2.9) at least partly to the hot blast air (4.1*) and/or at least partly to the optional charging material (4.3).

If only part of the discharged process gas (2.2) from the direct reduction process either by way of one of the variants (2.3, 2.9), (2.4, 2.9) or (2.5, 2.9), the remainder (2.6) may be supplied in a circuit to the direct reduction reactor (2), in particular combined with fresh gas (2.7), as mixed gas (2.8) to the reduction gas heater (20) and subsequently as hot reduction gas (2.1) to the direct reduction reactor (2). As and when required, the hot reduction gas (2.1) may be additionally enriched with oxygen (2.10).

Furthermore, through use and/or recycling of the discharged process gas (3.1, 4.4, 5.1, 6.1) from electric furnace (3), cokery (6), converter (5) and/or blast furnace (4), the energy balance of the integrated metallurgical plant (1) may also be substantially improved. For example, as fuel gas (4.6, 4.7) or as additive gas (4.6, 4.7) to the fuel gas for firing the reduction gas heater (20), the process gas (3.1) discharged from the electric furnace (3) may be provided at least partly as fuel gas (4.6, 4.7) and/or the process gas (5.1) discharged from the converter (5) may be provided at least partly as fuel gas (4.6, 4.7) and/or the process gas (4.4, 4.5) discharged from the blast furnace (4) may be provided at least partly as fuel gas (4.6, 4.7) and/or the process gas (6.1) discharged from the cokery (6) may be provided at least partly as fuel gas (4.6, 4.7) for firing the reduction gas heater (20) of the direct reduction reactor (2). According to mode of operation, the discharged process gas (3.1, 4.4, 5.1, 6.1) may be utilized by only one apparatus (3, 4, 5, 6) for firing, or by multiple apparatuses (3, 4, 5, 6). As and when required, additional fuel gas (4.8) may be admixed and/or supplied.

The process gas (4.4) discharged from the blast furnace (4) and also called top gas is used on the standard basis for purposes including the firing of the air heaters (10), and so it is entirely possible to divert a part (4.5) for firing the reduction gas heaters (20), the remainder (4.4) being used, in particular with further fuel gas (not represented), for firing the air heaters (10).

The process gas (4.6) may be passed through a unit for carbon dioxide removal to remove the $CO_2$ fraction, and so subsequently a carbon dioxide-free process gas (4.7) may be provided with improved efficiency in comparison to (4.6) for the firing of the reduction gas heater (20).

Furthermore, it is also possible (not represented in FIG. 1) to provide the discharged process gas (3.1, 5.1, 6.1) from electric furnace (3), cokery (6) and/or converter (5) not only as fuel gas (4.6, 4.7) or as additive gas (4.6, 4.7) to the fuel gas for firing the reduction gas heater (20), but additionally or even alternatively to supply it to the blast furnace (4) via the tuyeres together with the hot blast air (4.1*), with the process gas (2.2, 2.3, 2.4, 2.5, 2.9) discharged from the direct reduction reactor (2) and with the optional charging material (4.3), in order to make economic physical use of the process gas (3.1, 5.1, 6.1), which is low in nitrogen, in particular. According to mode of operation, the discharged process gas (3.1, 5.1, 6.1) may be utilized by only one apparatus (3, 5, 6) for blowing into the blast furnace (4), or by a plurality of apparatuses (3, 5, 6).

The invention claimed is:

1. A method for producing steel in an integrated metallurgical plant, the method comprising:

directly reducing iron ore to give sponge iron using at least one direct reduction reactor;

melting the sponge iron to give one of pig iron and crude steel using at least one electric furnace;

smelting iron ore to give pig iron using at least one blast furnace; refining pig iron to give crude steel using at least one converter; discharging process gas from the direct reduction reactor; and admixing the process gas at least partly to at least one of hot blast air and a charging material, the at least one of the hot blast air and the charging material being blown into the blast furnace via tuyeres.

2. The method of claim 1 wherein the process gas is admixed at least partly directly, without prior use of the process gas as fuel in an air heater for the hot blast air, to the at least one of the hot blast air and the charging material.

3. The method of claim 1 wherein the process gas is first dehumidified and then admixed as dehumidified process gas at least partly to at least one of the hot blast air and the charging material being blown into the blast furnace via tuyeres.

4. The method of claim 3, further comprising:

removing $CO_2$ fraction contained in the process gas or in the dehumidified process gas; and admixing the removed $CO_2$ as carbon dioxide-free process gas at least partly to at least one of the hot blast air and the charging material being blown into the blast furnace via tuyeres.

5. The method of claim 4 wherein the process gas discharged from the electric furnace is at least one of (i) provided at least partly as fuel gas for firing a reduction gas heater of the direct reduction reactor; and (ii) supplied at least partly to the blast furnace.

6. The method of claim 5 wherein at least two discharged process gases comprising at least the process gas discharged from the direct reduction reactor and the blast furnace top gas are provided at least partly as at least one of (i) fuel gas for firing the reduction gas heater of the direct reduction reactor; and (ii) supplied at least partly to the blast furnace.

7. The method of claim 4 wherein the integrated metallurgical plant comprises a cokery and wherein the process gas discharged from the cokery is at least one of (i) provided at least partly as fuel gas for firing the reduction gas heater of the direct reduction reactor; and (ii) is supplied at least partly to the blast furnace.

8. The method of claim 7 wherein at least two discharged process gases comprising at least the process gas discharged from the direct reduction reactor and the blast furnace top gas are provided at least partly as at least one of (i) fuel gas for firing the reduction gas heater of the direct reduction reactor; and (ii) supplied at least partly to the blast furnace.

9. The method of claim 4 wherein the process gas discharged from the blast furnace comprises blast furnace top gas and is provided at least partly as at least one of (i) fuel gas for firing the reduction gas heater of the direct reduction reactor; and (ii) supplied at least partly to the blast furnace.

10. The method of claim 9 wherein at least two discharged process gases comprising at least the process gas discharged from the direct reduction reactor and the blast furnace top gas are provided at least partly as at least one of (i) fuel gas for firing the reduction gas heater of the direct reduction reactor; and (ii) supplied at least partly to the blast furnace.

11. The method of claim 4 wherein the process gas discharged from the blast furnace comprises blast furnace top gas and is provided at least partly as fuel gas for firing the reduction gas heater of the direct reduction reactor.

12. The method of claim 11 wherein at least two discharged process gases comprising at least the process gas discharged from the direct reduction reactor and the blast furnace top gas are provided at least partly as at least one of (i) fuel gas for firing the reduction gas heater of the direct reduction reactor; and (ii) supplied at least partly to the blast furnace.

* * * * *